US009670709B2

(12) United States Patent
Taddei

(10) Patent No.: US 9,670,709 B2
(45) Date of Patent: Jun. 6, 2017

(54) MAIN DOOR FOR THE CONTROL OF THE ACCESS OPENING TO A COMPARTMENT, PARTICULARLY A GARAGE COMPARTMENT

(71) Applicant: SILVENTA S.R.L., Castelnuovo (IT)

(72) Inventor: Alberto Taddei, Castelnuovo (IT)

(73) Assignee: Silventa S.r.l., Castelnuovo (IT)

( * ) Notice: Subject to any disclaimer, the term of this patent is extended or adjusted under 35 U.S.C. 154(b) by 0 days.

(21) Appl. No.: 14/778,690

(22) PCT Filed: Feb. 27, 2014

(86) PCT No.: PCT/IB2014/059296
§ 371 (c)(1),
(2) Date: Sep. 21, 2015

(87) PCT Pub. No.: WO2014/147500
PCT Pub. Date: Sep. 25, 2014

(65) Prior Publication Data

US 2016/0047155 A1 Feb. 18, 2016

(30) Foreign Application Priority Data

Mar. 20, 2013 (IT) ..... MO2013A0073

(51) Int. Cl.
*E05D 15/38* (2006.01)
*E05D 13/00* (2006.01)
(Continued)

(52) U.S. Cl.
CPC ..... *E05D 15/38* (2013.01); *E05D 13/00* (2013.01); *E05D 13/1284* (2013.01);
(Continued)

(58) Field of Classification Search
CPC ..... E05D 15/16; E05D 15/22; E05D 15/262; E05D 15/268; E05D 15/38; E05D 15/445;
(Continued)

(56) References Cited

U.S. PATENT DOCUMENTS 8,807,294 B2 * 8/2014 Hsieh ..... F16D 59/02 109/33
9,162,094 B2 * 10/2015 Hsieh ..... A62C 3/14
(Continued)

FOREIGN PATENT DOCUMENTS

| | | |
|---|---|---|
| EP | 0326831 A1 | 8/1989 |
| IT | VR920014 U1 | 8/1993 |
| WO | 2012/117277 A1 | 9/2012 |

OTHER PUBLICATIONS

International Search Report dated Mar. 30, 2014 from International Patent Application No. PCT/IB2014/059296, filed Feb. 27, 2014.
(Continued)

*Primary Examiner* — Justin Rephann
(74) *Attorney, Agent, or Firm* — Sunstone IP

(57) ABSTRACT

The main door for the control of the access opening to a compartment, particularly a garage compartment, comprises: a fixed portion associable with the access opening of a compartment; a mobile portion including a leaf associated in a mobile way with the fixed portion; at least a pulley on which winds up a cable connected to the leaf and to a counterweight; an operating shaft of the pulley mounted on the fixed portion; a winding-unwinding device having a flexible element which can be wound and unwound which is associated with the top of the leaf; an electric motor mounted on the fixed portion and suitable for placing a driving shaft in rotation; and a transmission and distribution having a first electromagnetic clutch to transmit motion from the driving shaft to the operating shaft and a second electromagnetic
(Continued)

clutch to transmit motion from the driving shaft to the winding-unwinding device.

15 Claims, 8 Drawing Sheets

(51) Int. Cl.

| | |
|---|---|
| ***E05F 15/686*** | (2015.01) |
| ***E05F 15/643*** | (2015.01) |
| ***E05F 15/70*** | (2015.01) |
| ***E05D 15/16*** | (2006.01) |
| ***E05D 15/24*** | (2006.01) |
| ***E05D 15/36*** | (2006.01) |
| ***E05D 15/52*** | (2006.01) |
| ***E05D 15/58*** | (2006.01) |

(52) U.S. Cl.
CPC ..... *E05D 13/145* (2013.01); *E05D 15/165* (2013.01); *E05D 15/24* (2013.01); *E05D 15/36* (2013.01); *E05D 15/5211* (2013.01); *E05D 15/58* (2013.01); *E05D 15/583* (2013.01); *E05F 15/643* (2015.01); *E05F 15/686* (2015.01); *E05F 15/70* (2015.01); *E05Y 2201/216* (2013.01); *E05Y 2201/258* (2013.01); *E05Y 2201/412* (2013.01); *E05Y 2201/49* (2013.01); *E05Y 2400/40* (2013.01); *E05Y 2800/122* (2013.01); *E05Y 2800/21* (2013.01); *E05Y 2900/106* (2013.01)

(58) Field of Classification Search
CPC ..... E05D 15/463; E05D 15/583; E05D 13/00; E05D 13/145; E05D 13/1284; E05Y 2201/49; E05Y 2201/412; E05Y 2201/258; E05Y 2201/216; E05Y 2800/122; E05Y 2800/21; E05Y 2900/106; E05Y 2400/40
USPC ..... 49/197, 199
See application file for complete search history.

(56) References Cited

U.S. PATENT DOCUMENTS

| | | | | |
|---|---|---|---|---|
| 9,376,864 | B2 * | 6/2016 | Hsieh | E06B 9/84 |
| 2005/0235563 | A1 * | 10/2005 | Mullet | E05D 13/1261 49/200 |
| 2006/0124250 | A1 * | 6/2006 | Hsieh | E06B 9/82 160/9 |
| 2010/0005723 | A1 | 1/2010 | Evans | |
| 2011/0047877 | A1 * | 3/2011 | Hellinga | E05F 15/686 49/199 |
| 2012/0024484 | A1 * | 2/2012 | Hsieh | A62C 2/24 160/291 |
| 2014/0318719 | A1 * | 10/2014 | Hsieh | E06B 9/42 160/133 |

OTHER PUBLICATIONS

International Preliminary Report on Patentability dated Sep. 22, 2015 from International Patent Application No. PCT/IB2014/059296, filed Feb. 27, 2014.

* cited by examiner

MAIN DOOR FOR THE CONTROL OF THE ACCESS OPENING TO A COMPARTMENT, PARTICULARLY A GARAGE COMPARTMENT

TECHNICAL FIELD

The present invention relates to a main door for the control of the access opening to a compartment, particularly a garage compartment.

BACKGROUND ART

Main doors are known for closing garages or the like having a leaf composed of one or more panels moving along guides.

In the case of a single-panel leaf, the leaf has height and width dimensions equal to the entire access opening.

In the case of the leaf being composed of a plurality of panels, instead, the latter have a substantially rectangular shape, with width equal to the width of the access opening to the compartment, and are articulated with one another in various ways.

A particular example of a main door with the panels articulated to one another is shown in the patent document WO 2012/117277.

To open the leaf, devices are known including a reversible motor which commands an operating shaft which transmits movement to a pair of pulleys arranged alongside the leaf and designed to retransmit a respective cable loaded with a counterweight.

The pulleys therefore act both as supports for the counterweights and as parts for moving the leaf.

Due to the pressure differences between the inside of the compartment to be closed and the outside, differences mostly created by the fact that the compartment is closed or open, but exposed to air currents contrary to the direction of closing movement of the leaf, it often occurs that the leaf does not correctly come alongside the garage compartment walls or violently collides with the fixed frame.

The risk therefore exists of the main door remaining partially open or of it producing undesired noises and vibrations which over time can loosen the adherence of the frame fixed to the masonry.

Because these causes are to some extent tied to particular environmental conditions, it is extremely difficult, if not impossible without incurring heavy maintenance costs, to adequately adjust or permanently fine tune the main door.

To at least partially overcome the above drawbacks, the patent document IT 229412 teaches to use a transmission and distribution unit of the motor motion and a winding-unwinding device linked with the transmission and distribution unit.

The winding-unwinding device has a belt or a cable fastened to the top of the leaf, so that during leaf opening, the belt or the cable unwinds and during closing it passively rewinds, while in the final juxtaposition section, the winding-unwinding device starts up and drags the leaf to abut against the fixed structure.

The transmission and distribution unit consists of a mechanism with feelers, gear wheels, and conical and helical couplings which transfer the movement from the motor to the pair of pulleys during the leaf opening and closing phase, and to the winding-unwinding device during the final closing phase.

Such transmission and distribution unit is however considerably complicated from a mechanical-structural viewpoint and difficult to make, assemble and install, with consequent increase in total production costs which inevitably increase the retail price, with the risk of making the product less attractive for consumers.

DESCRIPTION OF THE INVENTION

The main object of the present invention is to provide an alternative solution for a main door for the control of the access opening to a compartment, particularly a garage compartment, which is highly reliable and able to ensure the pull-out and total closure of the leaf, in all circumstances, including in the event of the leaf being wrongly positioned respect to the fixed frame and in any temporary environmental condition.

A further object of the present invention consists in providing a main door for the control of the access opening to a compartment, particularly a garage compartment, which at the same time is easy to manufacture, simple to install and obtainable with particularly competitive production costs.

Another object of the present invention is to provide a main door for the control of the access opening to a compartment, particularly a garage compartment, which can overcome the above mentioned drawbacks of the prior art in the context of a simple, rational, easy to use and effective solution.

The above mentioned objects are achieved by the present main door for the control of the access opening to a compartment, particularly a garage compartment, having the characteristics of claim 1.

BRIEF DESCRIPTION OF THE DRAWINGS

Other characteristics and advantages of the present invention will become more evident from the description of a preferred but not exclusive embodiment of a main door for the control of the access opening to a compartment, particularly a garage compartment, illustrated by way of an indicative, but non limitative example, in the accompanying drawings wherein.

EMBODIMENTS OF THE INVENTION

Figure 6:
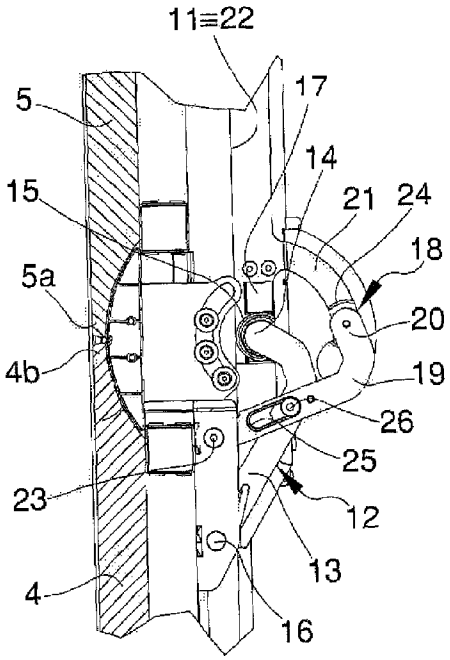
FIG. 6 is a sectional view, on an enlarged scale, of a detail of FIG. 2.
Figure 1:
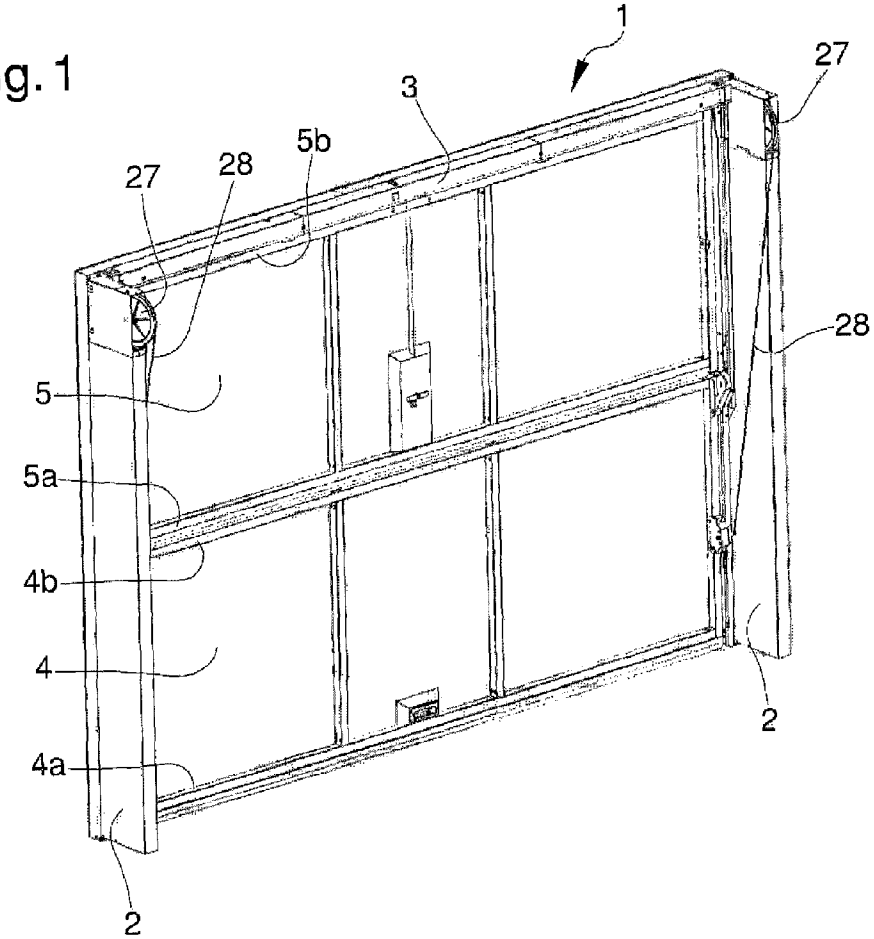
FIG. 1 is an axonometric view of the main door according to the invention.

With particular reference to these figures, globally indicated by 1 is a main door for the control of the access opening to a compartment, particularly a garage compartment.

The main door 1 comprises a frame or a fixed portion 2, 3, which includes a pair of lateral uprights 2, connected at the top to each other by an Upper crossbar 3.

Each lateral upright 2 is intended to be fixed to a respective shoulder of the compartment access opening.

The upper crossbar 3, on the other hand, is intended to be fixed to the architrave of the compartment access opening.

The main door 1 also comprises a mobile portion including a leaf 4, 5 associated in a mobile way with the fixed portion 2, 3.

In the embodiment shown in FIGS. 1-6, the leaf 4, 5 is composed of a lower panel 4 and an upper panel 5, which both have a substantially rectangular outline and extend over the entire width of the leaf 4, 5.

Alternative embodiments cannot however be ruled out wherein the leaf consists of a single panel, e.g., of the tilting type, or of three or more panels articulated to one another and/or to the fixed portion.

In the embodiment shown in the illustrations, to each lateral upright 2 is fixed a respective pair of vertical guides 6, 7, of which a first vertical guide 6 and a second vertical guide 7.

Each first vertical guide 6 (see e.g. the FIG. 4) has a length more or less the same as that of the respective lateral upright 2.

Each second vertical guide 7, on the other hand, has a length shorter than that of the respective first vertical guide 6, is fastened to the respective lateral upright 2 in a position adjacent to the first vertical guide 6 and extends parallel to it on the inner part of the compartment correspondence to the upper part of the first vertical guide 6.

In correspondence to their lateral sides, the panels 4, 5 are engaged sliding along a respective vertical guide 6, 7.

Typically, each vertical guide 6, 7 has a substantially C-shaped cross-section profile.

The concavity of a pair of vertical guides 6, 7 is turned towards the other pair.

The first vertical guide 6 is intended to engage sliding a respective first runner or idle roller 8 borne by a respective pin protruding laterally overhanging in correspondence to a lower section 4*a* of the lower panel 4.

The second vertical guide 7, on the other hand, acts as a sliding engagement seat for a respective second runner or idle roller 9 borne by a respective pin protruding overhanging in correspondence, in closing position, to a lower section 5*a* of the upper panel 5.

The upper panel 5 is laterally articulated to a pivoting axis 5*c* in correspondence to one of its intermediate zone to an extremity of a pair of lateral support arms 10 having their other extremity articulated in correspondence to the top of the pairs of vertical guides 6, 7 or the lateral uprights 2.

The upper panel 5 supports a pair of lateral sliding guides 11 having a length substantially the same or slightly longer than the height of the lower panel 4.

The two panels 4, 5 are interconnected, in correspondence to their extremities or side edges, by means of two articulated and sliding connection means or units 12, in order to form a single leaf for the main door 1.

More in particular, each articulated and sliding connection unit 12 laterally connects the upper section 4*b* of the lower panel 4 to the lower section 5*a* of the upper panel 5 and is composed of a connection lever or arm 13, e.g., with elbow shape.

Each connection lever 13 has a first end 14 with a runner or idle roller 15, intended, in use, to slide along a respective sliding seat delimited within the respective lateral sliding guide 11 of the upper panel 5.

Each connection lever 13, furthermore, has a second end 16 hinged on a pin in correspondence to the upper section 4*b* of the lower panel 4.

With such a configuration, the lower panel 4 and upper panel 5 can be moved between a completely closed position of the access opening, wherein they are arranged in sequence substantially aligned one on top of the other along the pairs of vertical guides 6, 7, and a completely open position, wherein the upper panel 5 is moved to project overhanging into the garage compartment starting from a zone in correspondence to the top of the pairs of vertical guides 6, 7 supported by the pair of lateral support arms 10 and the lower panel 4 is moved packed up against the upper panel 5.

Figure 3:
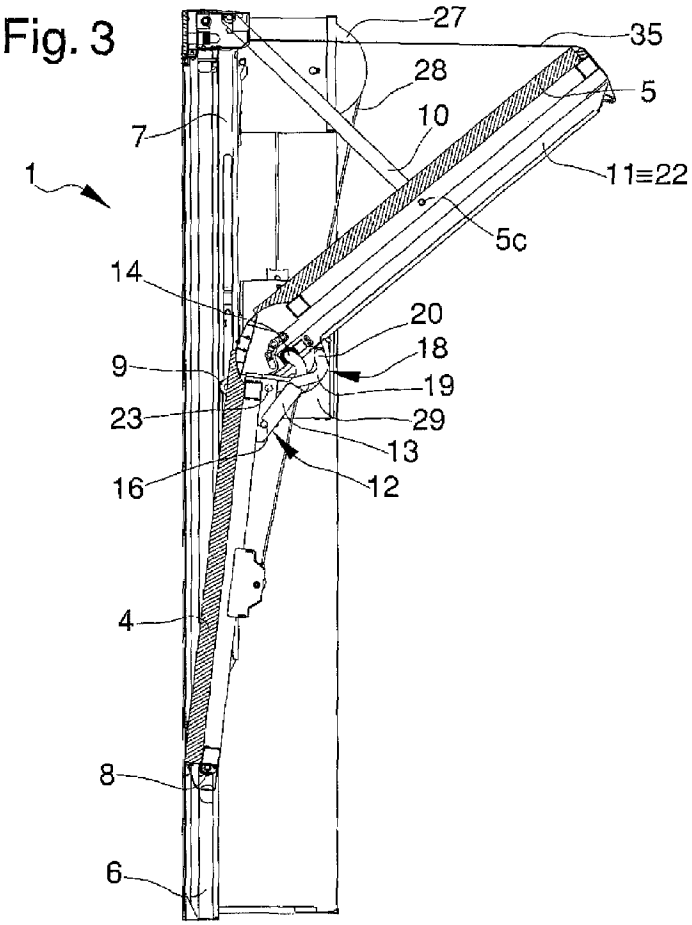
FIGS. 2 to 5 illustrate, in a succession of sectional views, the phase of opening the main door according to the invention.
Figure 2:
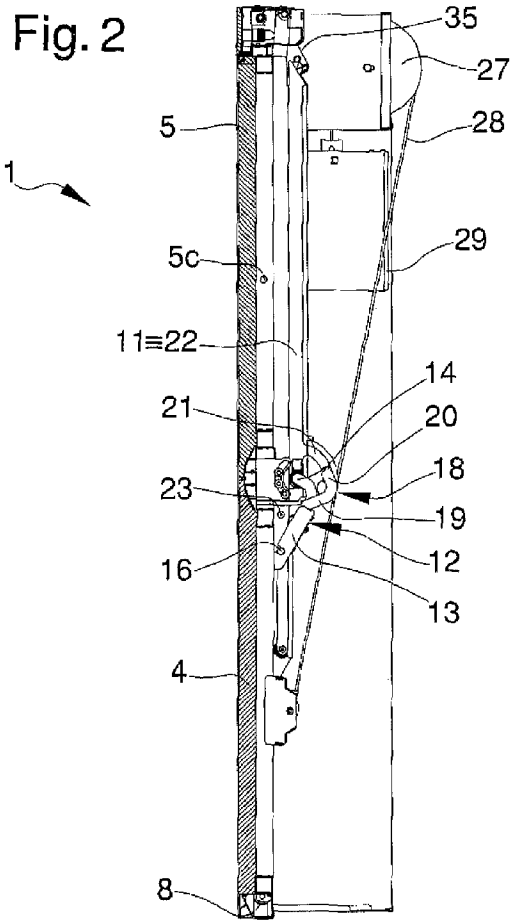

By observing in particular the figures from 2 to 5, it will be seen how the rollers 8 of the lower section 4*a* of the panel 4, starting from a complete closing arrangement (FIG. 2), are pushed to slide upwards along the respective first vertical guides 6 (FIG. 3).

This also translates into the elevation of the upper panel 5, which, being initially kept in alignment balance with the lower panel 4, is unbalanced so as to "fall" in a controlled way towards the inside of the compartment, oscillating around the articulation axis 5*c* to the lateral support arms 10.

Figure 4:
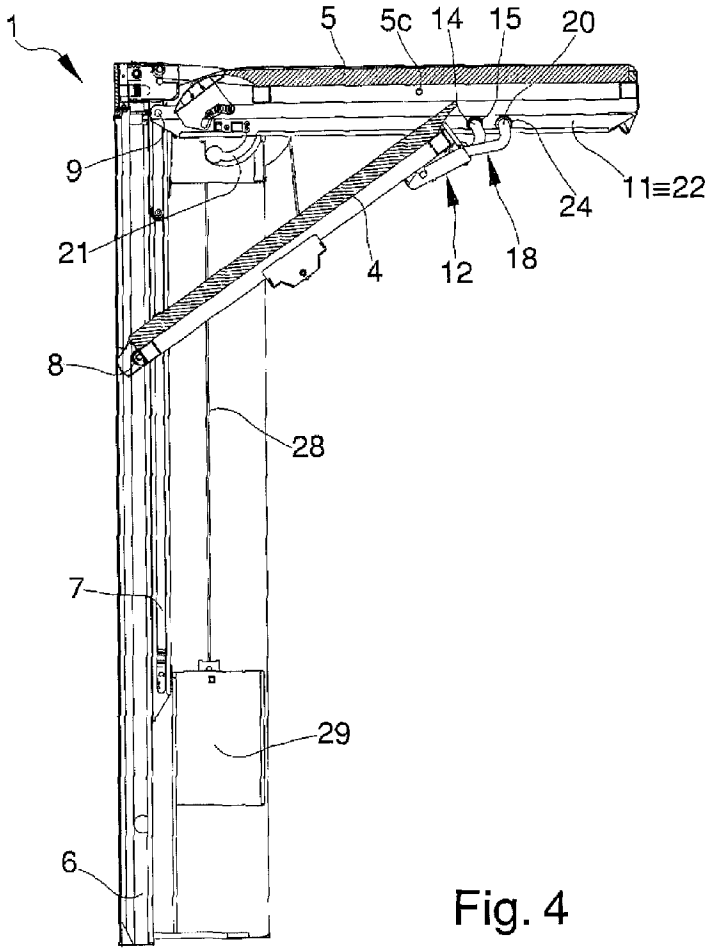
Figure 7:
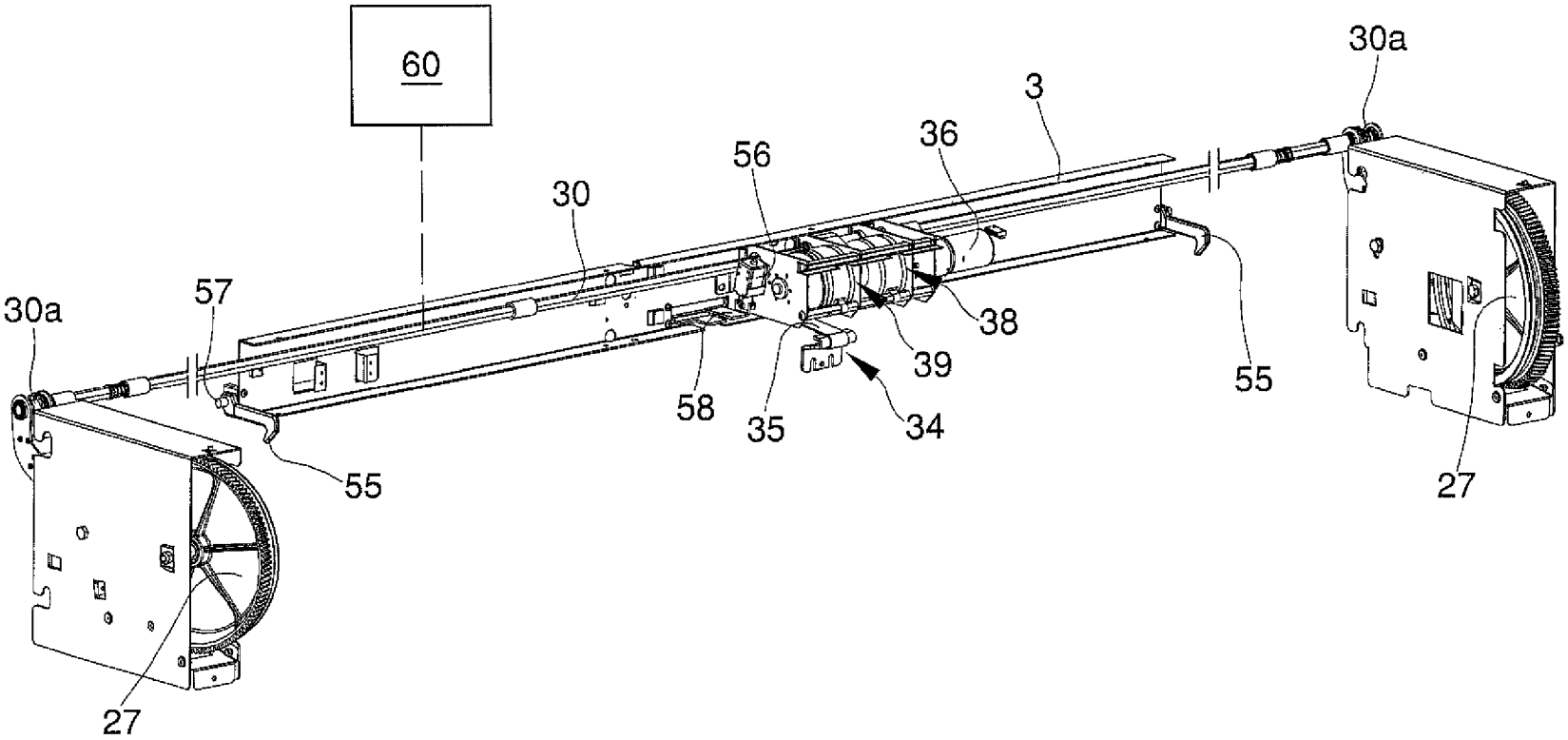
FIG. 7 is an axonometric view of a detail of the main door according to the invention.
Figure 8:
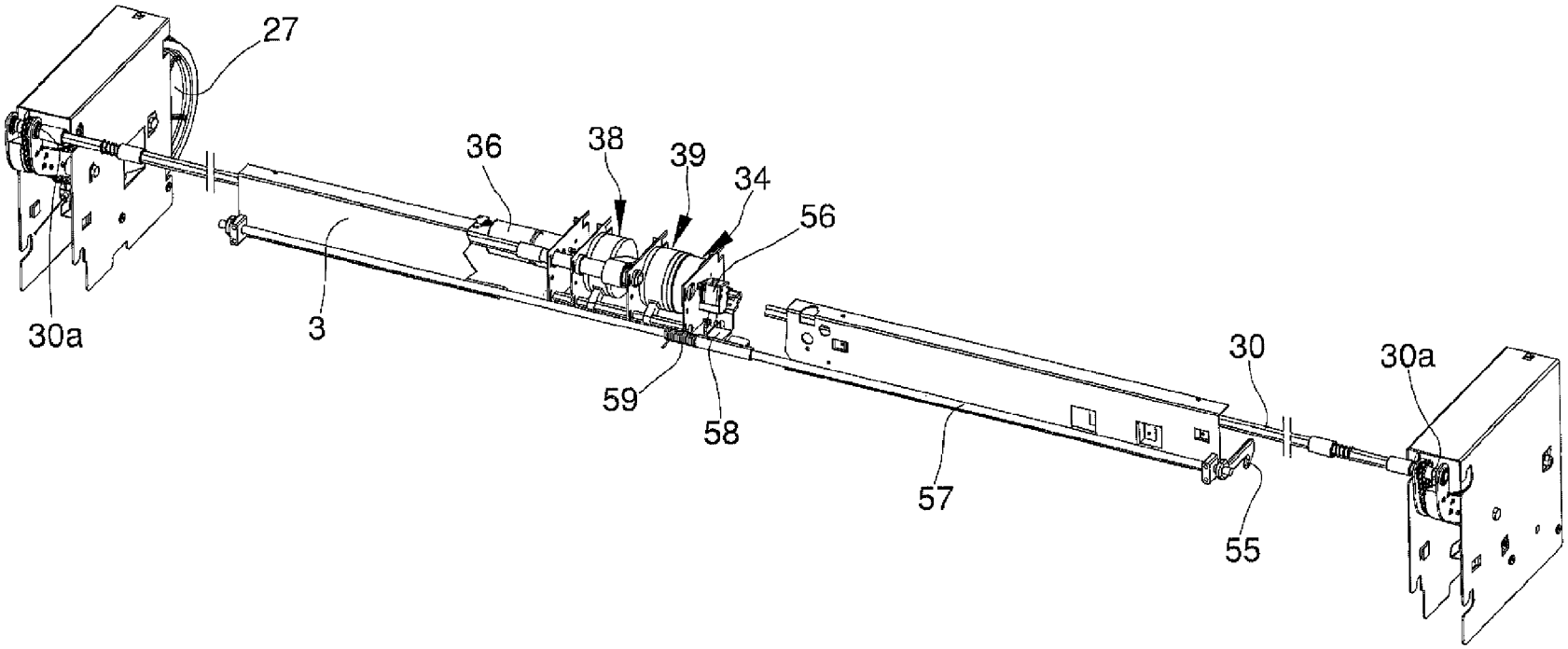
FIG. 8 is an axonometric view, from another angle, of the detail of FIG. 7.

The rollers 9 of the upper panel 5 start sliding along the second vertical guides 7, so the lower section 5*a* of the upper panel 5 is guided to return upwards until it is in an almost horizontal arrangement (FIG. 4).

Figure 5:
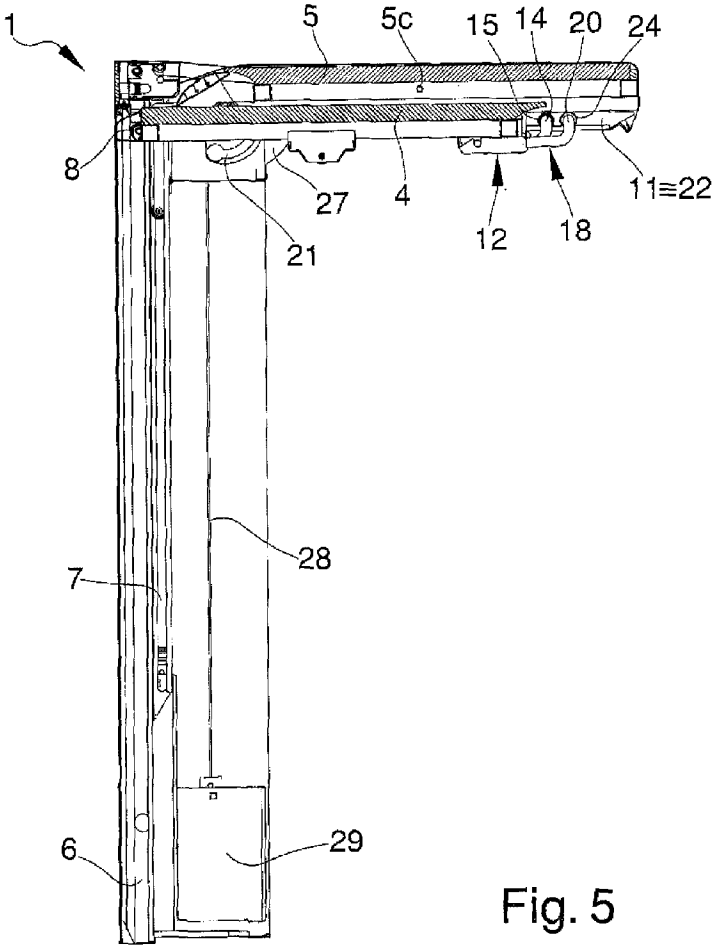

As the elevation continues, the upper section 4*b* of the lower panel 4, which is fastened to the lateral sliding guides 11 of the upper panel 5 by means of the connection levers 13 and the rollers 15, is pushed to move along and parallel to the upper panel 5 until it moves packed up against and below it (FIG. 5).

Until the substantially horizontal arrangement is reached of the upper panel 5, the rollers 15 of the articulated and sliding connection units 12 remain abutted against a removable stop element 17 protruding in the lateral sliding guides 11.

More in particular, each removable stop element 17 is part of a respective safety unit having the following functions:

- to temporarily block the first end 14 of the connection levers 13 in the proximity of the lower section 5*a* of the upper panel 5 until the upper panel 5 reaches a substantially horizontal configuration; and
- to release the first end 14 of the connection levers 13, leaving this free to slide along the respective lateral sliding guide 11, when the upper panel 5 is in a substantially horizontal configuration.

In practice, during the opening of the main door 1 starting from the complete closing position, the panels 4, 5 remain initially articulated to one another thanks to the connection levers 13, which have the first end 14 hinged in correspondence to the lower section 5*a* of the upper panel 5 and the second end 16 hinged to the upper section 4*b* of the lower panel 4, until the main door 1 reaches an intermediate position wherein the upper panel 5 is substantially horizontal.

From this time on, the upper panel 5 remains stopped in horizontal position and the first ends 14 of the connection levers 13 start to slide along the lateral sliding guides 11, until the complete opening position has been reached.

The movement of the connection levers 13, during the intermediate phases envisaged between the complete opening position and the complete closing position of the main door 1, is controllable by means of a respective articulation unit 18 associated with the articulated and sliding connection means 12.

There are two articulation units 18, one for each side of the main door 1, and these are able to guide the movement of the connection levers 13 and of the panels 4, 5 during the shift of the panels 4, 5 between the complete closing position and the complete opening position, and vice versa.

Each articulation unit 18 envisages a guide lever 19 having a first apex 20 engaged sliding along a guide path 21, 22 associated with the upper panel 5, and a second apex 23 articulated at the top of the lower panel 4.

More in detail, each first apex 20 has a runner or an idle roller 24 intended, in use, to slide along the guide path 21, 22.

The second apex 23, on the other hand, is hinged in correspondence to the upper section 4*b* of the lower panel 4.

Usefully, the guide path 21, 22 is split into:

- a curvilinear section 21, which is connected to the lateral sliding guides 11 of the upper panel 5 and which can be covered by the first apex 20 until the upper panel 5 reaches the substantially horizontal configuration; and
- a rectilinear section 22 of the lateral sliding guides 11, which can be covered by the first apex 20 when the upper panel 5 is in a substantially horizontal configuration.

As can be seen from the detail view of FIG. 6, furthermore, each guide lever 19 has a guide groove 25, in which is inserted in a sliding way a hinge pin 26 associated with a corresponding connection lever 13.

By means of the guide groove 25 and the hinge pin 26, the connection lever 13 and the guide lever 19 can rotate with respect to one another around a rotation axis (defined by the hinge pin 26) which moves along the guide groove 25 during elevation/lowering of the main door 1.

With such a configuration of the articulation unit 18 the movement of the main door 1 is as stable and smooth as ever.

In particular, it will be noticed that, in the absence of guide levers 19, the mechanical system made up of the lower panel 4, the upper panel 5 and the connection levers 13 has two degrees of freedom; thanks to the introduction of the guide levers 19, on the other hand, the system loses a degree of freedom and the relative position of the connection levers 13 with respect to the upper panel 5 is univocally determined for any position assumed by the lower panel 4, and vice versa.

In particular, in the complete closing position (FIG. 2), the first end 14 of the connection levers 13 is blocked by the removable stop element 17 in correspondence to the lower section 5*a* of the upper panel 5, while the first apex 20 is inserted along the curvilinear section 21 of the guide path 21, 22.

When the main door 1 opening movement starts (see FIG. 3), with the elevation of the lower panel 4 and the angular excursion of the upper panel 5 which starts to move to a substantially horizontal position, the first end 14 remains blocked by the removable safety stop element 17 while the first apex 20 covers the curvilinear section 21; the connection levers 13 do not therefore change their angle with respect to the lower panel 4, thus maintaining smoother the upward movement of the lower panel 4 until the intermediate position is reached, wherein the upper panel 5 is substantially horizontal.

At this moment, the sliding rollers or runners 15 of the connection levers 13 free themselves and can slide towards the upper section 5*b* of the upper panel 5 together with the idle rollers or runners 24 of the guide levers 19, which slide along the rectilinear section 22 of the lateral sliding guides 11 (FIG. 4).

Such sliding determines an angular movement of the connection levers 13 and of the guide levers 19 towards the lower panel 4 until the complete opening position is reached, wherein the connection levers 13 and the guide levers 19 arrange themselves substantially parallel to the lower panel 4 (FIG. 5).

The complete closing movement of the main door 1, starting from the complete opening position, is performed in a specular way.

The main door 1 also comprises counterweight means which control the reciprocal movement of the lower panel 4 and of the upper panel 5 and are able to make the movement of the main door 1 easy and balanced during the opening-closing operations.

Such counterweight means include at least a pulley 27 which is associated in a revolving way with the top of at least one of the lateral uprights 2 and on which is wound, at least in part, a cable 28 connected, at one extremity, to the leaf 4, 5 and, at the other extremity, to a counterweight 29.

In the embodiment shown in the illustrations, there are two pulleys 27, cables 28 and counterweights 29, one for each lateral upright 2.

Alternative embodiments cannot however be ruled out contemplating only one pulley 27.

In the embodiment shown in the figures from 1 to 6, furthermore, wherein the leaf is defined by two panels 4, 5, the cables 28 are associated with an intermediate portion of the lower panel 4.

It is easy to appreciate, however, that in the case of single-panel embodiments or with three or more panels, the connection point of the cables 28 can be different.

Within the scope of the present invention, furthermore, by the term "cable 28" shall be meant any flexible element which, wrapped on the pulleys 27, can act as a cable in the strict sense of the word, and therefore also a belt, a chain or the like.

Preferably, the counterweights 29 are housed within the lateral uprights 2 which, in such case, are of the boxed type.

The start of rotation of the pulleys 27 is achieved by means of at least one operating shaft 30 fitted on the upper crossbar 3 in a way rotatable around its own axis.

More in detail, the operating shaft 30 extends horizontally along the upper crossbar 3.

Figure 9:
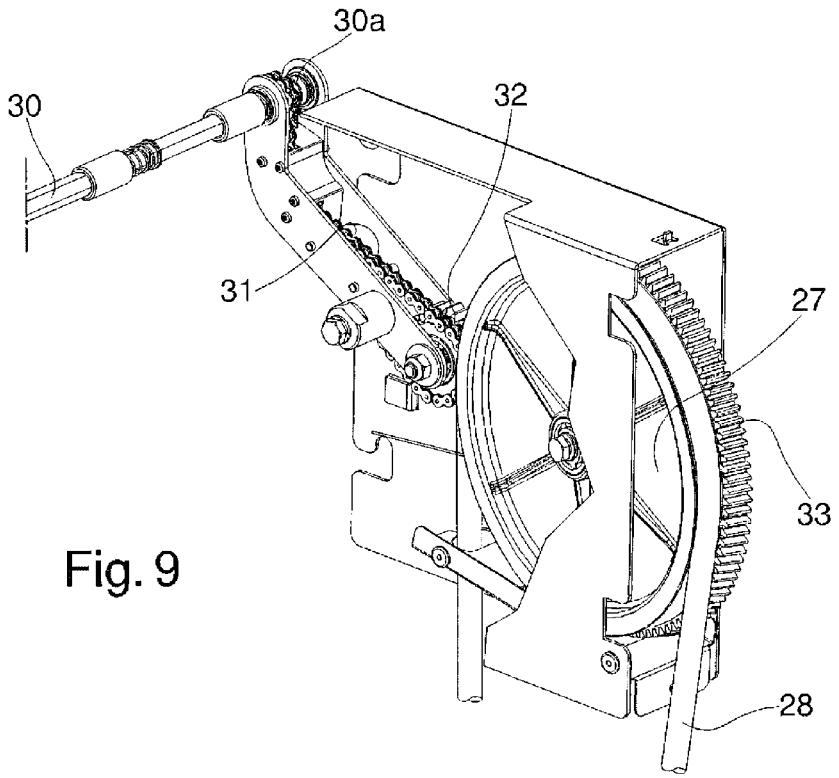
FIG. 9 is an axonometric view, on an enlarged scale, of a detail of FIG. 7.
Figure 10:
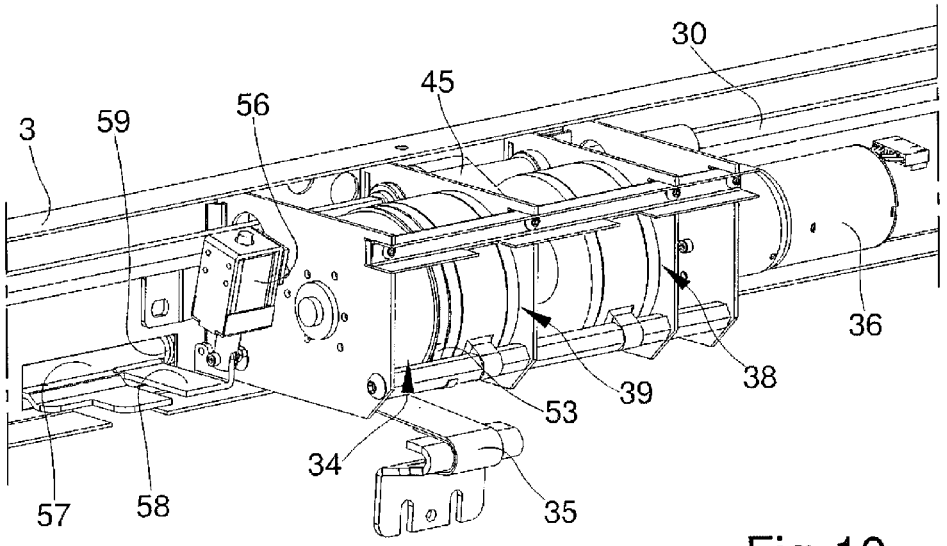
FIG. 10 is an axonometric view, on an enlarged scale, of another detail of FIG. 7.
Figure 11:
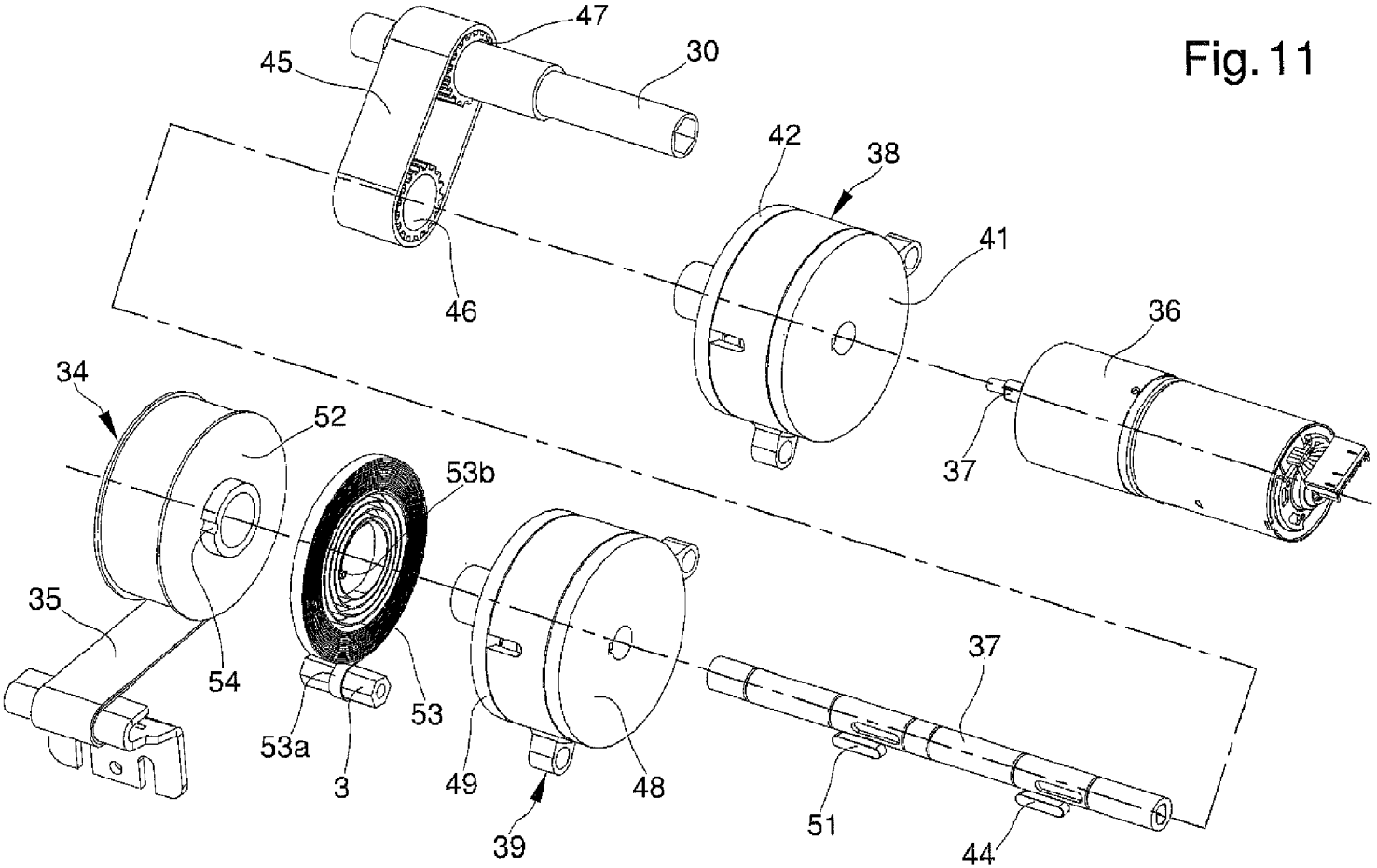
FIG. 11 is an exploded view of the detail of FIG. 10.
Figure 12:
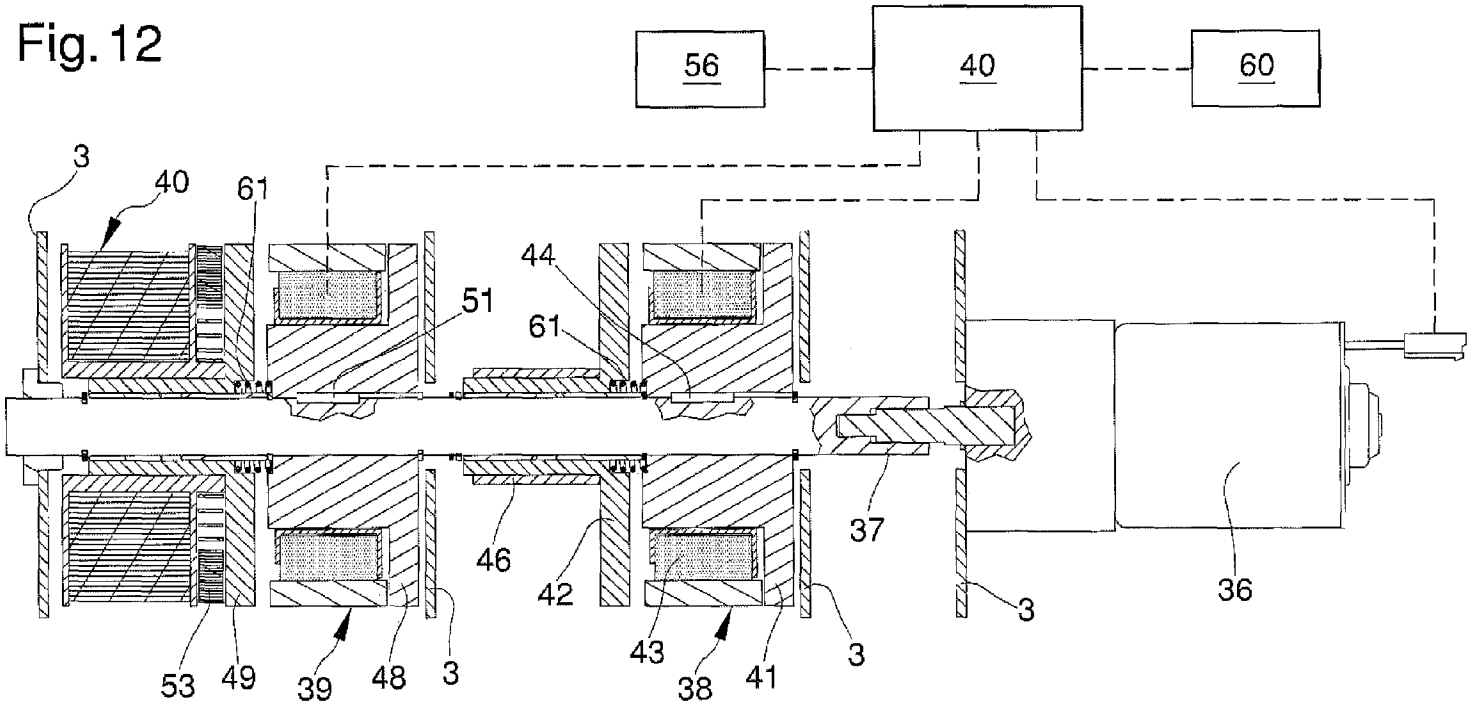
FIG. 12 is a sectional view of the detail of FIG. 10.
Figure 13:
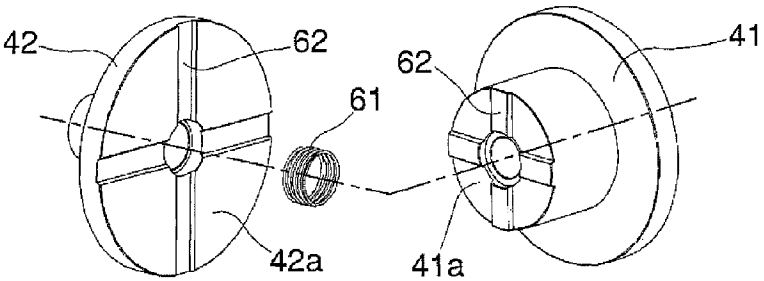
FIG. 13 is an exploded view of a detail of the first electromagnetic clutch envisaged by the main door according to invention.

The extremities 30*a* of the operating shaft 30 are arranged in the proximity of the pulleys 27 and bear a chain mechanism 31 which starts the rotation of a toothed pinion 32 engaging with a toothing 33 obtained on each pulley 27 (FIG. 9).

The main door 1 also comprises at least one winding-unwinding device 34 mounted on the upper crossbar 3 and having a flexible element 35 which can be wound and unwound.

The flexible element 35 is of the band or chain type or the like and has one extremity associated with the top of the leaf 4, 5.

On the upper crossbar 3 is also mounted at least one electric motor 36, having an output shaft 36*a* which is able to start in rotation a driving shaft 37.

More in detail, the driving shaft 37 is substantially horizontal and parallel to the operating shaft 30.

In the embodiment shown in the illustrations, the driving shaft 37 is keyed and in direct drive with the output shaft 36*a*.

Alternative embodiments cannot however be ruled out wherein the output shaft 36*a* and the driving shaft 37 are connected by means of a reduction unit or other mechanical connection.

The electric motor 36 permits motorizing the pulleys 27 and the winding-unwinding device 34.

For this purpose a transmission and distribution unit 38, 39, 40 is provided for the motion of the electric motor 36, able to transmit and distribute the motion from the driving shaft 37 to the operating shaft 30, for starting in rotation the pulleys 27, and to the winding-unwinding device 34, for the operation of the same.

The transmission and distribution unit 38, 39, 40, in detail, comprises:

- at least a first electromagnetic clutch or electro-pulley 38, interposed between the driving shaft 37 and the operating shaft 30;
- at least a second electromagnetic clutch or electro-pulley 39 interposed between the driving shaft 37 and the winding-unwinding device 34; and
- at least an electronic processing and control unit 40 that is electronically connected to the first electromagnetic clutch 38 and to the second electromagnetic clutch 39 and which is able to operate the first electromagnetic clutch 38, to transmit the motion from the driving shaft 37 to the operating shaft 30, and to operate the second electromagnetic clutch 39, to transmit the motion from the driving shaft 37 to the winding-unwinding device 34.

The first electromagnetic clutch 38 comprises:

- a first motion receiving body 41, which is mounted around the driving shaft 37 and is keyed onto the same;
- a first motion transmitting body 42, which is mounted around the driving shaft 37 and kinematically associated with the operating shaft 30;
- a first electrical winding 43 able to generate a solidarization electromagnetic field for solidarizing the first motion receiving body 41 and the first motion transmitting body 42.

The first motion receiving body 41 consists, e.g., of a first disc-shaped body associated with the driving shaft 37 by means of a first key 44 or other keying system.

The first motion transmitting body 42 consists, e.g., of a second disc-shaped body which is fitted on the driving shaft 37 in a freely rotatable way with respect to this, e.g., by interposition of a bearing or the like.

The first electrical winding 43 consists, e.g., of a coil through which electrical current can pass to generate the relative solidarization electromagnetic field.

The first electrical winding 43 is electronically connected to the electronic processing and control unit 40, which commands the flow of current through it.

The first motion receiving body 41 and the first motion transmitting body 42 are normally released the one from the other but, when current passes through the first electrical winding 43, these solidarize and the rotation of the driving shaft 37 is transferred to the first motion transmitting body 42 through the first motion receiving body 41.

For this purpose, at least one between the first motion receiving body 41 and the first motion transmitting body 42 is mobile along a direction parallel to the driving shaft 37 in a direction of reciprocal approach and away movement and in contrast with return means 61.

More in detail, the first motion receiving body 41 is fixed to the driving shaft 37 while the first motion transmitting body 42 is sliding parallel to the driving shaft 37.

The first motion receiving body 41 and the first motion transmitting body 42 also comprise respective faces 41*a*, 42*a* facing each other and having front profiles 62 reciprocally engageable the one in the other.

The return means 61, e.g., are of the elastic type and consist of a helical spring placed in between the faces 41*a*, 42*a*.

When the first electrical winding 43 is off, the return means 61 tend to leave the first motion receiving body 41 and the first motion transmitting body 42 at such a distance that the front profiles 62 do not engage with one another.

When electrical current passes through the first electrical winding 43, on the other hand, the first motion transmitting body 42 moves closer to the first motion receiving body 41 and the front profiles 62 of a face 41*a*, 42*a* engage with those of the other face 41*a*, 42*a*, solidarizing the first motion receiving body 41 and the first motion transmitting body 42 the one with the other.

The transmission and distribution unit 38, 39, 40 also comprises at least one flexible body 45 closed on itself in a loop and wound around a first wheel 46 associated with the first motion transmitting body 42 and a second wheel 47 associated with the operating shaft 30.

The flexible body 45 consists, e.g., of a belt, a band, a cable, a chain or the like.

The first wheel 46 and the second wheel 47 are substantially facing each other, i.e., arranged in correspondence to one another so that the flexible body 45 extends crossways to the operating shaft 30 and to the driving shaft 37.

The first wheel 46 and the second wheel 47, furthermore, are preferably of the toothed type.

The second electromagnetic clutch 39 comprises:

- a second motion receiving body 48, which is mounted around the driving shaft 37 and is keyed onto the same;
- a second motion transmitting body 49, which is mounted around the driving shaft 37 and kinematically associated with the winding-unwinding device 34; and
- a second electrical winding 50 able to generate a solidarization electromagnetic field for solidarizing the second motion receiving body 48 and the second motion transmitting body 49.

The second motion receiving body 48 consists, e.g., of a third disc-shaped body associated with the driving shaft 37 by means of a second key 51 or other keying system.

The second motion transmitting body 49 consists, e.g., of a fourth disc-shaped body which is fitted on the driving shaft 37 in a freely rotatable way with respect to this, e.g., by interposition of a bearing or the like.

The second electrical winding 50 consists, e.g., of a coil through which electrical current can pass to generate the relative solidarization electromagnetic field.

The second electrical winding 50 is electronically connected to the electronic processing and control unit 40, which commands the flow of current through it.

The second motion receiving body 48 and the second motion transmitting body 49 are normally released the one from the other but, when current passes through the second electrical winding 50, these solidarize and the rotation of the driving shaft 37 is transferred to the second motion transmitting body 49 through the second motion receiving body 48.

For this purpose, the second motion receiving body 48 and the second motion transmitting body 49 can be made in a totally identical way to the first motion receiving body 41 and to the first motion transmitting body 42, providing return means 61 and front profiles 62 completely similar to those of the first electromagnetic clutch 38.

The winding-unwinding device 34 comprises a reel 52 to wind up the flexible element 35 that is associated with the second motion transmitting body 49.

The winding-unwinding device 34 also comprises resilient means 53 for the return of the reel 52.

In the embodiment shown in the figures, the resilient means 53 consist in at least a spiral spring having one extremity 53*a* associated with the upper crossbar 3 and an opposite extremity 53*b* associated with at least one of the second motion transmitting body 49 and the reel 52.

In the embodiment shown in the illustrations, the opposite extremity 53*b* engages in a recess 54 obtained in the reel 52.

The main door 1 also comprises at least one block and release device 55, 56 for blocking and releasing the leaf 4, 5 in the completely closed position.

The block and release device 55, 56 comprises at least one hook 55 for blocking-releasing the leaf 4, 5 and at least one operating actuator 56 that moves the hook 55.

The hook 55 comprises, e.g., at least one hooking element or harpoon that is associated with the upper crossbar 3 in a revolving way and which protrudes overhanging from the upper crossbar 3 to intercept the leaf 4, 5.

There are preferably two hooking elements 55 and these are fitted on a rod 57 which extends horizontally along the upper crossbar 3.

The operating actuator 56, on the other hand, comprises at least one electromagnet associated with an operating leverage 58 which start the rotation of the rod 57 and the of hooking elements 55 in contrast to a spring 59.

The electromagnet 56 is electronically connected to the electronic processing and control unit 40, which commands its operation at the time of opening the main door 1, so as to rotate the operating leverage 58 together with the rod 57 and raise the harpoons 55.

The electronic processing and control unit 40 is also electronically connected to the electric motor 36 to its switching on and off.

The electronic processing and control unit 40 is also electronically connected to the sensor means 60 to detect the position of the leaf 4, 5.

The sensor means 60, e.g., consist of a detection device, of an encoder type or the like, which is mounted on the operating shaft 30 and which detects the angular position thereof and/or the number of revolutions with respect to a predefined position.

Thanks to the sensor means 60, the electronic processing and control unit 40 is able to command the opening and closing of the main door 1 according to the position of the leaf 4, 5, e.g., by controlling the energizing timing of the electromagnet 56, of the electric motor 36, of the first electrical winding 43 and of the second electrical winding 50.

Starting from the complete closing position, in fact, the electronic processing and control unit 40 commands, in this order:

- the start of the electromagnet 56, to lift the harpoons 55;
- the start of the electric motor 36 for the start of rotation of the driving shaft 37 in the direction of rotation which permits the opening thereof;
- the energizing of the first electromagnetic clutch 38, with the second electromagnetic clutch 39 remaining deactivated, which directs the driving torque to the operating shaft 30 and to the pulleys 27 until the main door 1 is completely open.

Starting from the complete opening position, on the other hand, the electronic processing and control unit 40 commands, in this order:

- the start of the electric motor 36 for the start of rotation of the driving shaft 37 in the direction of rotation opposite the previous one, which permits the closure thereof;
- the energizing of the first electromagnetic clutch 38, with the second electromagnetic clutch 39 remaining deactivated, which directs the driving torque to the operating shaft 30 and to the pulleys 27 to start the closure of the main door 1;
- the energizing of the first electromagnetic clutch 38, with the second electromagnetic clutch 39 remaining deactivated, which directs the driving torque to the operating shaft 30 and to the pulleys 27 to close the main door 1 until the lower section 5*a* of the leaf 4, 5 arrives in the proximity of the upper crossbar 3;
- the energizing of the second electromagnetic clutch 39, with the first electromagnetic clutch 38 remaining deactivated, which directs the driving torque to the winding-unwinding device 34 to complete the closure.

In this way, during the opening and closing of the leaf 4, 5, the flexible element 35 unwinds and winds passively held in tension only by the resilient means 53, while in the final stretch of the approaching of the leaf 4, 5 to the fixed portion 2, 3, the winding-unwinding device 34 is activated by dragging the leaf 4, 5 to abut against the fixed portion 2, 3.

The invention claimed is:

1. A main door for the control of an access opening to a compartment, comprising:

- a fixed portion associable with the access opening of the compartment and comprising two lateral uprights and an upper crossbar;
- a mobile portion including at least a leaf associated in a mobile way with said fixed portion;
- at least a pulley associated with the top of at least one of said lateral uprights and on which winds up at least partially a cable connected to the leaf and to a counterweight;
- at least an operating shaft of said pulley mounted on said upper crossbar;
- at least a winding-unwinding device mounted on said upper crossbar and having a flexible element which can be wound and unwound which is associated with the top of said leaf;
- at least an electric motor mounted on said upper crossbar and suitable for placing a driving shaft in rotation; and
- at least a transmission and distribution unit associated with said electric motor, suitable for transmitting and distributing a motion from said driving shaft to said operating shaft and to said winding-unwinding device;

wherein said transmission and distribution unit comprises:

- at least a first electromagnetic clutch placed between said driving shaft and said operating shaft;
- at least a second electromagnetic clutch placed between said driving shaft and said winding-unwinding device; and
- at least an electronic processing and control unit which is electronically connected to said first electromagnetic clutch and to said second electromagnetic clutch and which is suitable for operating said first electromagnetic clutch, to transmit said motion from said driving shaft to said operating shaft, and for operating said second electromagnetic clutch, to transmit said motion from said driving shaft to said winding-unwinding device.

2. The main door according to claim 1, wherein said first electromagnetic clutch comprises:

a first motion receiving body, which is mounted around said driving shaft and keyed onto it;

a first motion transmitting body, which is mounted around said driving shaft and kinematically associated with said operating shaft;

a first electrical winding suitable for generating a solidarization electromagnetic field for solidarizing said first motion receiving body and said first motion transmitting body.

3. The main door according to claim 2, wherein said transmission and distribution unit comprises at least a flexible body closed on itself in a loop and wound around a first wheel associated with said first motion transmitting body and with a second wheel associated with said operating shaft.

4. The main door according to claim 3, wherein said driving shaft is substantially parallel to said operating shaft and said wheels are substantially facing each other.

5. The main door according to claim 2, wherein said second electromagnetic clutch comprises:

a second motion receiving body which is mounted around said driving shaft and keyed onto it;

a second motion transmitting body, which is mounted around said driving shaft and kinematically associated with said winding-unwinding device; and a second electrical winding suitable for generating a solidarization electromagnetic field for solidarizing said second motion receiving body and said second motion transmitting body.

6. The main door according to claim 5, wherein said winding-unwinding device comprises a reel to wind up said flexible element associated with said second motion transmitting body.

7. The main door according to claim 6, wherein said winding-unwinding device comprises resilient means for tensioning said flexible element.

8. The main door according to claim 7, wherein said resilient means comprise at least a spiral spring having an extremity associated with said upper crossbar and an opposite extremity associated with at least one of said second motion transmitting body and said reel.

9. The main door according to claim 1, wherein said electronic processing and control unit is electronically connected to sensor means to detect the position of said leaf.

10. The main door according to claim 9, wherein said sensor means comprise a detection device which is mounted on said operating shaft and which detects the angular position thereof with respect to a predefined position.

11. The main door according to claim 1, wherein said main door comprises at least a block and release device for blocking and releasing said leaf when said leaf is in a closed position.

12. The main door according to claim 11, wherein said block and release device comprises at least a hook for blocking and releasing said leaf and at least an operating actuator of said hook.

13. The main door according to claim 12, wherein said hook comprises at least a hooking element which is associated with said upper crossbar so that said hooking element can rotate with respect to said upper crossbar and which protrudes overhanging from said upper crossbar to intercept said leaf.

14. The main door according to claim 13, wherein said operating actuator comprises at least an electromagnet associated with an operating leverage for operating the rotation of said hooking element.

15. The main door according to claim 1, wherein:

said fixed portion includes two pairs of vertical guides associated with said lateral uprights;

said leaf comprises a lower panel and an upper panel with a substantially rectangular outline, extending over the entire width of the leaf and having the lateral sides thereof in sliding engagement along a respective vertical guide; and said mobile portion comprises a pair of lateral support arms each having one extremity thereof pivotally coupled to the top of a respective pair of vertical guides and another extremity thereof pivotally coupled to an intermediate zone of a respective lateral side of said upper panel;

said mobile portion comprises articulated and sliding connection means between said lower panel and said upper panel, including a pair of lateral sliding guides provided in correspondence to the lateral sides of said upper panel, and a pair of connection levers, each having one first end thereof in sliding engagement with a respective lateral sliding guide of said upper panel and a second end thereof articulated at the top of said lower panel, said lower panel and said upper panel being movable between a completely closed position of said access opening, in which they are arranged in a sequence substantially aligned one on top of the other, along said pairs of vertical guides, and a completely open position, in which said upper panel is moved to project overhanging into said compartment starting from a zone in correspondence to the top of said pairs of vertical guides, supported by said pair of lateral support arms and said lower panel is substantially parallel and proximate said upper panel.

* * * * *